US006588620B1

(12) United States Patent
Thuma et al.

(10) Patent No.: US 6,588,620 B1
(45) Date of Patent: Jul. 8, 2003

(54) KNOCKDOWN HAMPER

(75) Inventors: Michael C. Thuma, LaGrange, IL (US); Larry Hauser, Chicago, IL (US); Carla De Young, Joliet, IL (US); Edward John Rohr, Jr., Chicago, IL (US)

(73) Assignee: Home Products International, Inc., Chicago, IL (US)

( * ) Notice: Subject to any disclaimer, the term of this patent is extended or adjusted under 35 U.S.C. 154(b) by 0 days.

(21) Appl. No.: 10/255,797

(22) Filed: Sep. 26, 2002

(51) Int. Cl.[7] ..... C25D 13/00

(52) U.S. Cl. ..... 220/489; 220/485; 220/4.28; 220/23.91; 220/908.1

(58) Field of Search ..... 220/485, 489, 220/491, 4.28, 23.91, 908.1

(56) References Cited

U.S. PATENT DOCUMENTS

| | | | | | |
|---|---|---|---|---|---|
| 462,361 | A | * | 11/1891 | Miller | 220/6 |
| 1,091,907 | A | * | 3/1914 | Benners | 220/4.28 |
| 1,865,533 | A | * | 7/1932 | Lutzke | 220/485 |
| D138,327 | S | * | 7/1944 | Smith et al. | |
| 3,979,856 | A | * | 9/1976 | Belcher | 47/76 |
| 4,250,664 | A | * | 2/1981 | Remke | 47/76 |
| 4,836,392 | A | * | 6/1989 | Constantino | 211/133.5 |
| 5,667,066 | A | | 9/1997 | Simpson | |
| 5,881,975 | A | | 3/1999 | Bianco | |
| 5,964,533 | A | | 10/1999 | Ziglar | |
| 6,089,394 | A | | 7/2000 | Ziglar | |
| D434,538 | S | | 11/2000 | Thompson | |
| 6,227,398 | B1 | | 5/2001 | Yang et al. | |

* cited by examiner

*Primary Examiner*—Joseph M. Moy
(74) *Attorney, Agent, or Firm*—Wood, Phillips, Katz, Clark & Mortimer

(57) ABSTRACT

A knockdown, or collapsible, hamper including a frame formed from two generally U-shaped supports with bottom portions and upstanding members. The bottom portions are pivotally connected and positioned perpendicularly with respect to one another for assembly of the hamper. A plurality of rings are affixed to the frame and held in place by notches in the upstanding members of the U-shaped supports. A bag is positioned inside the frame and ring structure to complete the hamper.

7 Claims, 4 Drawing Sheets

KNOCKDOWN HAMPER

FIELD OF THE INVENTION

This invention pertains to collapsible hampers that may be compactly stored or transported in a collapsed state and deployed into a usable assembled hamper. Particularly, the hamper is easily assembled and disassembled as required by the end user.

BACKGROUND OF THE INVENTION

Hampers that are typically used to store and/or transport laundry or other lightweight articles and are stored and shipped fully assembled and ready for use. The bulkiness and size of many of these hampers increases the shipping costs of such items and presents shelf space and storage problems for merchants. However, to be of use, laundry hampers must be large enough in size to hold a reasonable amount of dirty clothing.

Hampers are available in a great variety of types and designs. Hampers have typically been constructed of wicker or plastic. Such hampers may have a top closure or cover that is hinged to the container and serves to shut the container when it is not in use. Another type of hamper consists of a fabric bag that is supported upon a frame or stand.

Some hampers have been shipped in parts requiring assembly by the merchant upon arrival or by the consumer upon purchase. These collapsible baskets and containers have typically included a variety of pre-shaped components that require alignment and fastening that is difficult, tedious and may require a variety of tools.

Accordingly, there is a need for a laundry hamper that can be conveniently shipped, transported, stored and that can be quickly and easily assembled for use.

SUMMARY OF THE INVENTION

The invention provides a knockdown, or collapsible, hamper. The hamper has a frame that includes two generally U-shaped supports defining a bottom portion and upstanding members. The bottom portion has cross-members that rotate about a pivot point and the upstanding members extend obliquely from the bottom portion, and form the generally vertical, upstanding members of the frame. A plurality of rings slide over the bottom portion and along the upstanding members and are received in notches formed in the upstanding members to create a generally conical shape with the bottom portion and upstanding members of the frame.

In one embodiment, the collapsible hamper includes a frame that is formed from two generally U-shaped supports. The generally flat bottom portions of the U-shaped supports are connected near the center of each bottom portion and, by a scissors-type movement, the supports can pivot from a generally flat cross-section to a maximum cross-section in which the two bottom generally cross perpendicularly. The upstanding members of the U-shaped supports have notches formed therein that are spaced apart from one another. The notches on each of the upstanding members correspond with the notches on the other upstanding members and align horizontally. A plurality of rings of varying circumferences perpendicularly align with the upstanding members and click or snap or are set securely into the notches. The frame and rings form a generally conical shaped structure. A bag is fitted into the conical shaped structure providing a hamper ready for use.

Other objects and advantages of the invention, as well as additional inventive features, will be apparent from the description of the invention provided herein and in the associated figures and appended claims.

DETAILED DESCRIPTION OF THE INVENTION

Figure 1:
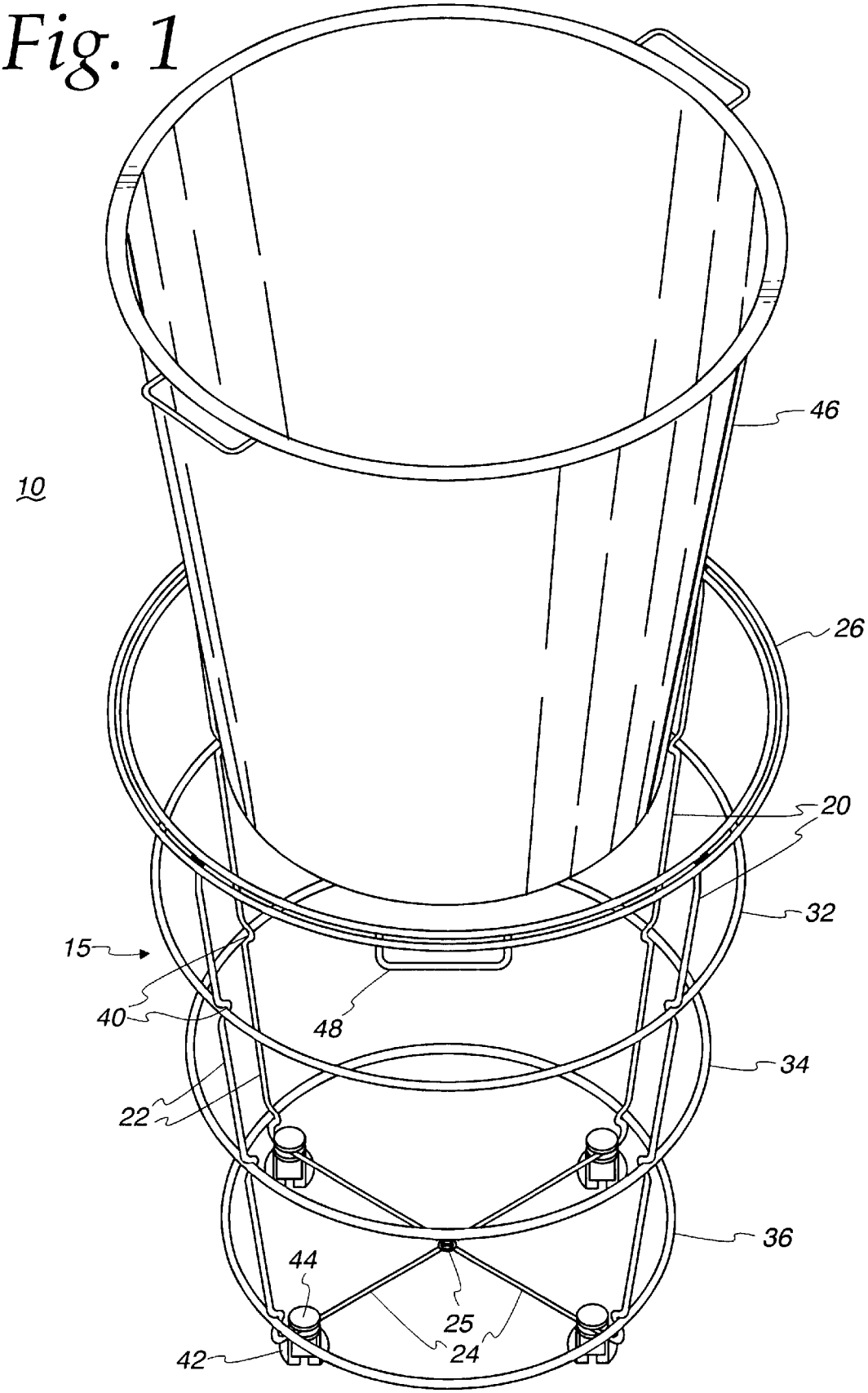
FIG. 1 is a perspective view of a hamper embodying the invention.
Figure 2:
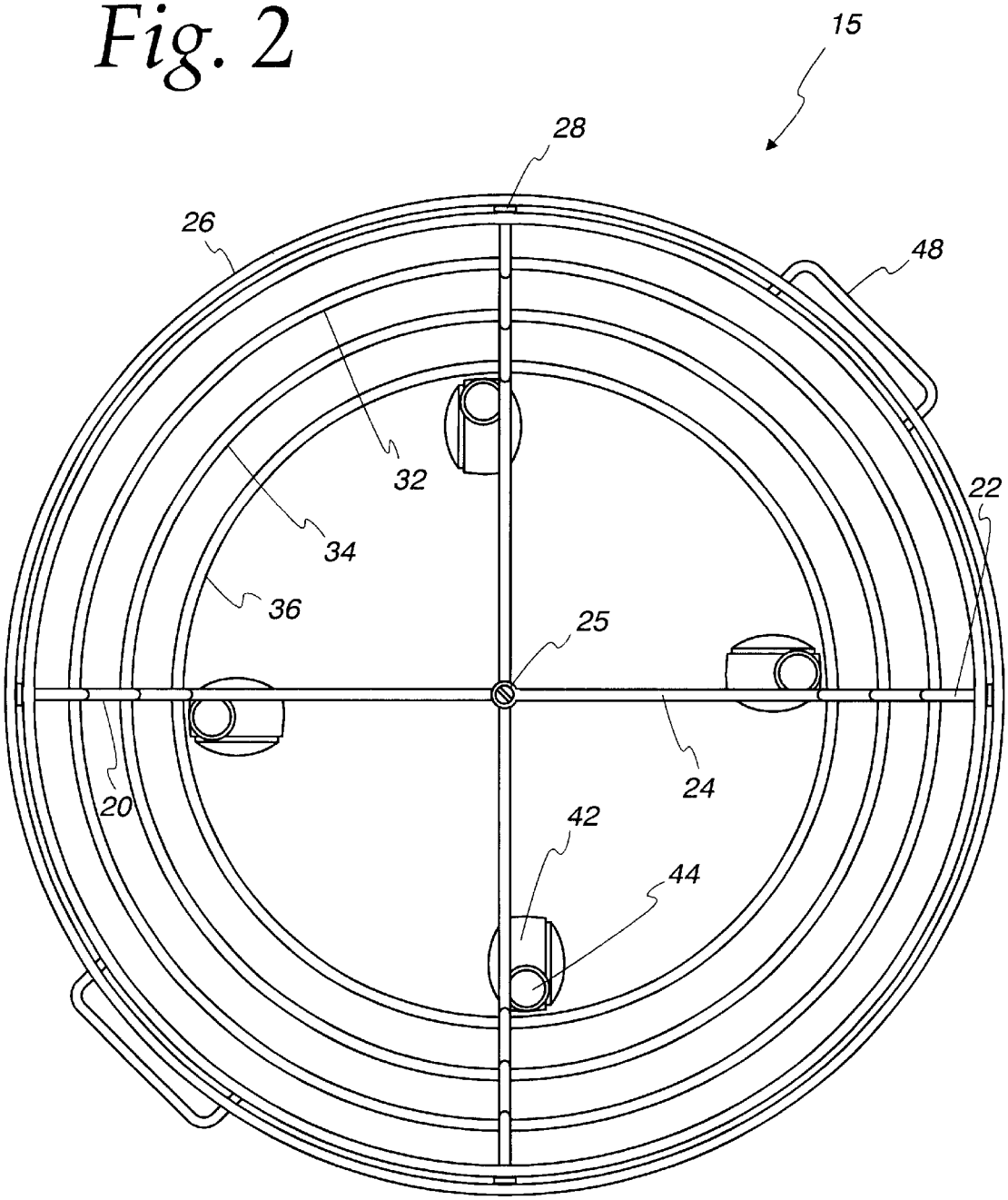
FIG. 2 is a top view of the hamper depicted in FIG. 1.
Figure 3:
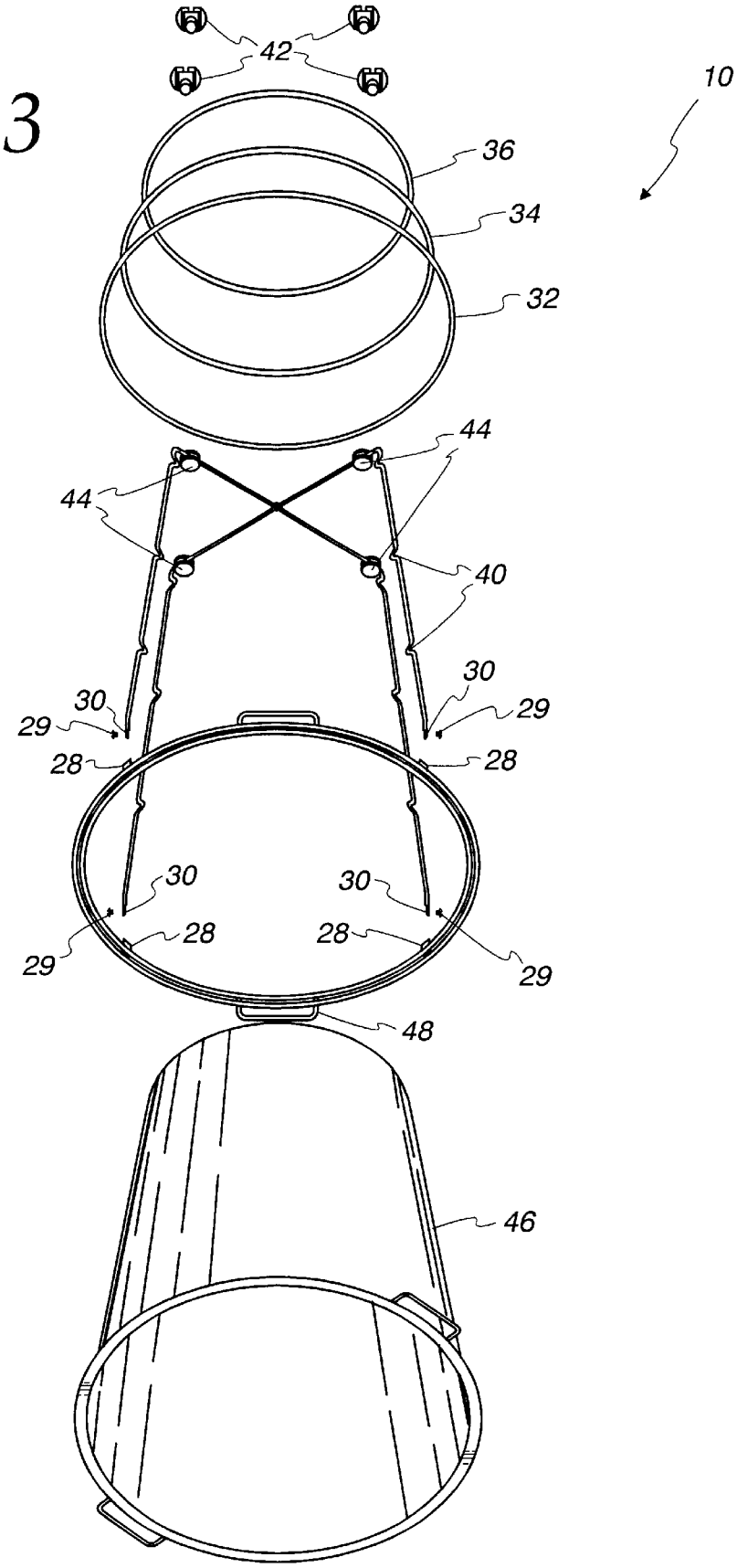
FIG. 3 is an exploded view of the components of the hamper of FIG. 1.
Figure 4:
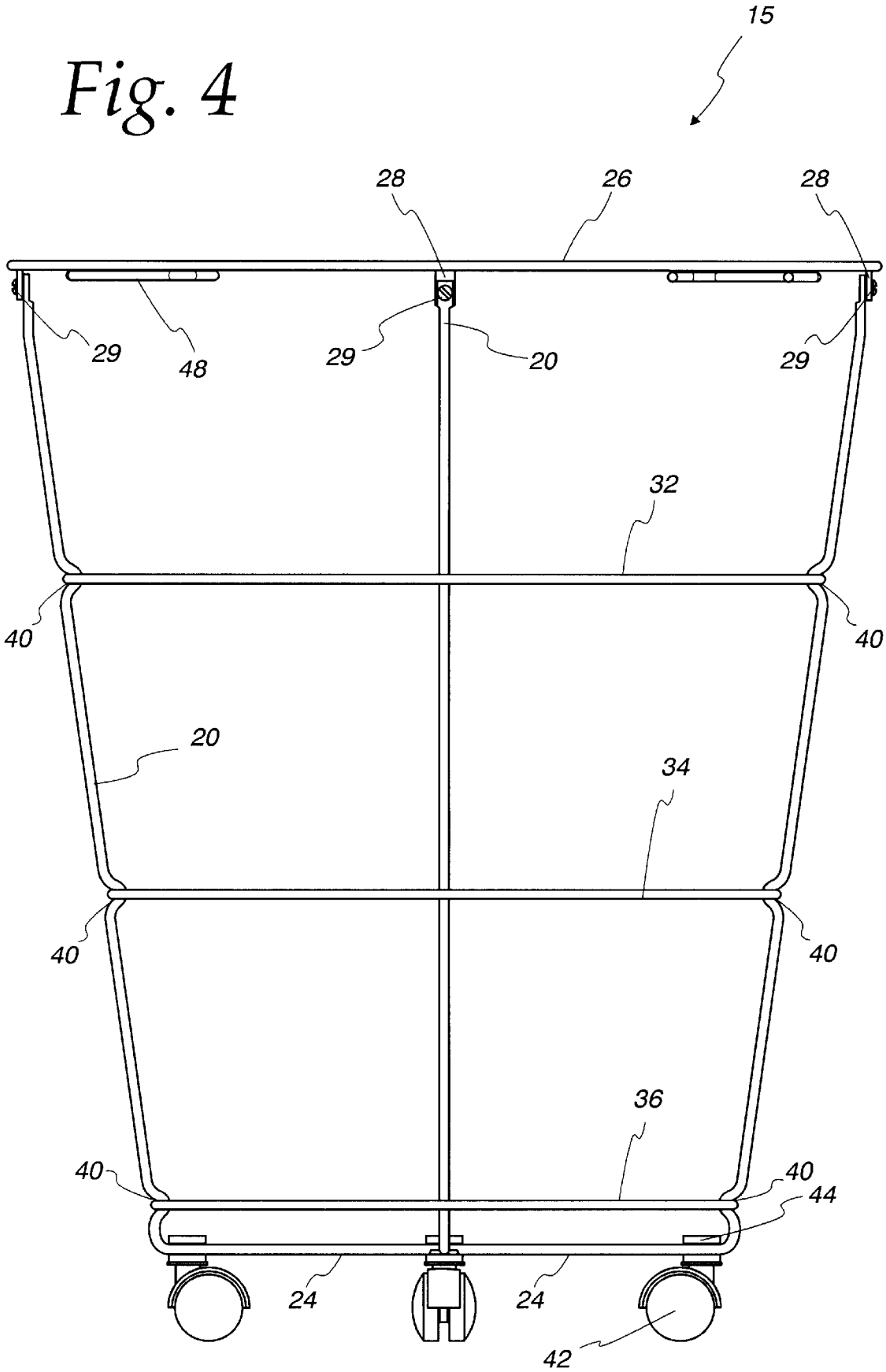
FIG. 4 is a side view of a hamper embodying the invention.

A collapsible hamper 10 embodying the present invention is illustrated in FIGS. 1–4 and includes a frame 15 comprised of two generally U-shaped supports 20. The two U-shaped supports 20 include upstanding members 22 and bottom portions 24. The bottom portions 24 are fastened together, for example, by machine screw 25 and cap nut. The fastening of the bottom portions 24 of the U-shaped supports 20 is such that the bottom portions 24 may pivot within a range of a minimum cross-section at which point the bottom portions 24 approach a parallel arrangement with one another and, on the opposite extreme of the range, a perpendicular orientation in which the bottom portions 24 intersect in a substantially perpendicular arrangement. The Figures depict a double ring 26 with tabs 28. The tabs 28 are aligned with tabs 30 of upstanding members 22 of the U-shaped supports 20 when the bottom portions 24 are oriented generally perpendicular to one another.

Referring to FIGS. 1–4, a series of rings 32, 34, 36 are affixed to the upstanding members 22 of the U-shaped supports 20. The rings 32, 34, 36 are aligned generally perpendicular to the upstanding members 22 of the U-shaped supports 20 and are received into notches 40 formed into the upstanding members 22. When the rings 32, 34, 36 are received in the notches 40 of the upstanding members 22 of the U-shaped support 20, the U-shaped support 20 and rings 32, 34, 36 form a generally conical-shaped structure. The notches 40 are formed into a length of the upstanding members 22 at intervals that correspond to the intervals between the notches 40 of the each other upstanding member 22. The frame 15, double ring 26 and rings 32, 34, 36 are preferably stainless steel or aluminum wire or tubing, but may be drawn or cast from any suitable metal or alloy.

The circumference of each of the rings 32, 34, 36 corresponds to a circumference of a cross-section of the hamper 10 where the rings 32, 34, 36 will be received along the conical shape. The notches 40 are placed and shaped to allow the rings 32, 34, 36 to click or snap in place and to maintain their position during use of the hamper 10. In order for the rings 32, 34, 36 to maintain their position in the notches 40, the rings 32, 34, 36 may temporarily deform the upstanding members 22 as the rings 32, 34, 36 slide along the upstanding member 22 and into the notches 40. Upon the receiving of the rings 32, 34, 36 in the notches 40 of the upstanding members 22, the shape of the hamper 10 is fixed and held rigid. The preferred embodiment may also include casters 42 affixed to mounting sleeves 44 on the bottom portions 24 of the frame 15 in a well known manner. A bag 46 is fitted over handles 48 of the double ring 26. The bag 46 is preferably canvas, but may be fabricated of a lighter cotton, wool or blended natural fiber or may be plastic or non-woven fabric. The hamper 10 may, optionally, include a hamper lid (not shown) of a design appropriate to fit the top opening of the hamper 10.

To begin assembly, the consumer pivots the U-shaped supports 20 to a position in which the bottom portions 24 are oriented substantially perpendicular to one another. The consumer then mates the tabs 28 of the double ring 26 with the tabs 30 of the upstanding members 22 of the U-shaped supports 20 and fixes the tabs 28, 30 together, for example, by screws 29. Assembly of the hamper is continued by inverting the frame 15/double ring 26 assembly and arranging a series of rings 32, 34, 36 in the order of largest 32, then middle 34 and then smallest 36 according to circumference. The largest ring 32 is placed over the bottom portions 24 of the frame 15 and moved along the upstanding members 22 of the frame 15 toward the double ring 26. Travel of the largest ring 32 continues along the upstanding members 22 of the frame 15 until the circumference of the largest ring 32 is contacted by each the upstanding members 22 in a generally perpendicular orientation to the plane of the ring 32. The consumer will then set, snap or click the ring 32 into one of a plurality of notches 40 on each upstanding member 22 that has been formed for the purpose of receiving the ring 32.

Assembly of the hamper continues by placement of the middle ring 34 and then the smallest ring 36 in the same manner as the largest ring 32 was placed. Casters 42 are then optionally placed in mounting sleeves 44 affixed to the bottom portions 24 of the frame 15. The structure is then returned to an upright position from the inverted position. A bag 46 is fitted into the frame 15 and over handles 48 of the double ring 26. The hamper 10 is then complete and ready for use. The hamper 10 may be readily disassembled most easily by reversing the order of assembly steps.

The manufacture and use of the hamper described herein can decrease costs incurred for transport and storage of hampers. End users may quickly, easily and with minimal tool requirements assemble and disassemble the hamper. While these potential advantages and objects have been identified herein, it should be understood that all embodiments of the invention may not provide all, or any, of the identified advantages and objects.

The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A collapsible hamper comprising:

a frame including at least two generally U-shaped supports, said supports each having a bottom portion and two upstanding members extending from the respective ends of said bottom portion;

each of said supports being pivotally joined to one another so as to permit movement of the bottom portions between a generally parallel orientation to a generally perpendicular orientation;

each of said upstanding members having a plurality of spaced apart notches formed therein such that each of the notches in each of the upstanding members is in a common plane with a notch in the other of said upstanding members;

a plurality of rings of varying diameter, each of said rings has an inner circumference for receipt and retention within the notches in a common plane; and a bag positioned within and supported by said frame.

2. The collapsible hamper of claim 1, further comprising two sleeves are mounted onto to each bottom portion.

3. The collapsible hamper of claim 2, wherein casters are affixed to the mounting sleeves.

4. The collapsible hamper of claim 1, wherein a double ring is fixed to the upstanding members of the frame.

5. The collapsible hamper of claim 4, wherein the double ring has at least one handle.

6. The collapsible hamper of claim 1, wherein the U-shaped supports are stainless steel or aluminum.

7. The collapsible hamper of claim 1, wherein the bag is a material selected from the group consisting of canvas, light weight cotton, polyester, wool, blended natural fiber, plastic and non-woven fabric.

* * * * *